US008939227B2

(12) United States Patent
Theobalds

(10) Patent No.: US 8,939,227 B2
(45) Date of Patent: Jan. 27, 2015

(54) PRESSURE PROTECTION VALVE FOR HYDRAULIC TOOL

(75) Inventor: Francis Theobalds, St. Albans (GB)

(73) Assignee: Caterpillar Inc., Peoria, IL (US)

( * ) Notice: Subject to any disclaimer, the term of this patent is extended or adjusted under 35 U.S.C. 154(b) by 403 days.

(21) Appl. No.: 13/298,717

(22) Filed: Nov. 17, 2011

(65) Prior Publication Data

US 2012/0160528 A1 Jun. 28, 2012

Related U.S. Application Data

(60) Provisional application No. 61/426,594, filed on Dec. 23, 2010.

(51) Int. Cl.

| | |
|---|---|
| ***B25D 9/00*** | (2006.01) |
| ***E02F 3/96*** | (2006.01) |
| ***B25D 9/12*** | (2006.01) |
| ***E02F 9/22*** | (2006.01) |

(Continued)

(52) U.S. Cl.

CPC . *E02F 3/966* (2013.01); *B25D 9/12* (2013.01); *E02F 9/2267* (2013.01); *F15B 13/024* (2013.01); *B25D 9/16* (2013.01)

USPC ..... 173/1; 173/177; 173/200

(58) Field of Classification Search

CPC ..... B25D 9/16; B25D 9/18; B25D 9/14; B25D 9/145; B25D 9/265; B25D 2250/195; B25D 9/20; B25C 1/046; B25C 1/04; F16K 31/12; F01L 15/00; F01L 15/02; F01L 15/18

USPC ..... 173/1, 114, 90, 135, 200, 208, 9, 11, 173/177, 14, 112; 251/73, 149, 149.1, 251/149.8, 238, 337, 149.6, 144, 153, 154; 91/246, 446, 517; 60/426, 452, 422, 60/468; 137/458, 461, 489.5, 495, 487, 137/115.23, 492.5

See application file for complete search history.

(56) References Cited

U.S. PATENT DOCUMENTS

| | | | |
|---|---|---|---|
| 3,276,468 | A | 10/1966 | Lebow |
| 3,664,435 | A | 5/1972 | Klessig |
| 3,942,322 | A | 3/1976 | Hammarstrand |

(Continued)

FOREIGN PATENT DOCUMENTS

| | | | |
|---|---|---|---|
| DE | 1253542 | B | 11/1967 |
| EP | 1925825 | A2 | 5/2008 |

(Continued)

*Primary Examiner* — Thanh Truong
*Assistant Examiner* — Joy N Sanders
(74) *Attorney, Agent, or Firm* — Finnegan, Henderson, Farabow, Garrett & Dunner LLP

(57) ABSTRACT

A pressure protection valve is provided which provides a fluid short circuit between a fluid pressure inlet of a hydraulic tool such as a hydraulic hammer and a low pressure region when the pressure at the fluid pressure inlet exceeds a first trigger pressure equal to a predetermined permissible pressure. This prevents damage to the hydraulic tool which can arise through operation at excessive fluid flow or pressure from hydraulic fluid supplied by a carrier vehicle. The pressure protection valve may maintain fluid communication between the fluid pressure inlet and the low pressure region until the pressure at the fluid pressure inlet reduces to a pressure below a predetermined second trigger pressure which is less than the first trigger pressure, to prevent further operation of the tool until the flow of fluid to the fluid pressure inlet has been stopped by an operator.

15 Claims, 4 Drawing Sheets

(51) Int. Cl.
*F15B 13/02* (2006.01)
*B25D 9/16* (2006.01)

(56) References Cited

U.S. PATENT DOCUMENTS

| | | | | |
|---|---|---|---|---|
| 4,285,362 | A * | 8/1981 | Taylor | 137/489 |
| 4,413,687 | A | 11/1983 | Eklof | |
| 4,418,764 | A | 12/1983 | Mizobe | |
| 5,653,295 | A | 8/1997 | Juvonen et al. | |
| 6,334,494 | B1 | 1/2002 | Nagato | |
| 6,672,403 | B2 | 1/2004 | Ahr et al. | |
| 6,938,702 | B2 | 9/2005 | Saha et al. | |
| 6,959,967 | B1 | 11/2005 | Prokop et al. | |
| 7,779,930 | B2 | 8/2010 | Lohmann et al. | |
| 2005/0129531 | A1 | 6/2005 | Fenny et al. | |
| 2009/0090525 | A1 * | 4/2009 | Juvonen | 173/1 |

FOREIGN PATENT DOCUMENTS

| | | | |
|---|---|---|---|
| GB | 567645 | A | 2/1945 |
| WO | 2007003705 | A1 | 1/2007 |

* cited by examiner

PRESSURE PROTECTION VALVE FOR HYDRAULIC TOOL

RELATED APPLICATIONS

This application is based upon claims the benefit of priority from U.S. Provisional Application No. 61/426,594 by Francis Theobalds, filed Dec. 23, 2010, the contents of which are expressly incorporated herein by reference.

TECHNICAL FIELD

The present disclosure relates to hydraulic tools, and more particularly to a pressure protection valve for a hydraulic hammer and other hydraulic tool to prevent the tool from being operated at excessive working pressure.

BACKGROUND

Fluid-powered impact vibrators, such as hydraulic hammers, may be used for crushing rock, concrete or other building materials, and may be provided as accessory parts or attachments for a carrier machine, such as excavators, loaders or other construction machines.

Hydraulic hammers generally comprise a percussion piston arranged for reciprocating movement within a cylinder housing by controlled hydraulic fluid pressure. The piston drives a work tool such as a chisel, blade or rock breaking bit.

Typically an impact vibrator may be attached to the jib of a fluid-powered excavator or other carrier machine, and may be connected via a fluid pressure inlet line as well as a return flow line to the hydraulic fluid supply unit for the fluid-powered excavator. The fluid pressure inlet line provides hydraulic fluid at high pressure while the return flow line is a low pressure region.

The percussive piston movement in the operating stroke direction or in the opposite, return stroke direction may be affected by a piston control valve that is associated with or integrated into the hydraulic hammer. In particular, the control valve can include a spool valve acting upon two annular percussion piston surfaces of different size, which are located in opposite movement direction, such that the smaller annular surface (effective in the return stroke direction) is always connected to the input pressure line, and the larger annular surface (effective in the operating stroke direction) is connected via the spool valve alternately to the fluid pressure inlet line and the return flow line.

The hydraulic fluid supplied by the carrier machine is designed for the internal power demands of the carrier machine itself, and is not always at an optimum pressure or flow rate for an attached hydraulic tool. Excessive fluid flow from the carrier machine, excessive back pressure from a poor hydraulic kit installation on the carrier machine, or an incorrectly adjusted control valve on the hydraulic hammer can each result in a hydraulic hammer being operated using a hydraulic pressure greater than that specified for the hydraulic hammer.

It is known to provide a pressure-limiting valve in conjunction with the piston control valve, so that when the pressure in the fluid pressure inlet line exceeds a predetermined maximum pressure, the pressure-limiting valve causes the piston control valve to the operating stroke position, thereby stopping operation of the hydraulic hammer. However the piston control valve remains in the operating stroke position only as long as the pressure in the fluid pressure inlet line exceeds the predetermined maximum pressure. When the pressure in the fluid pressure inlet line is reduced below the predetermined maximum pressure the piston control valve is free to return to the return stroke position, thereby resuming operation of the hydraulic hammer. This may result in uncontrolled restarting of the operation of the hydraulic hammer.

The present disclosure is directed to overcoming one or more of the problems as set forth above.

SUMMARY OF THE INVENTION

In one aspect, the present disclosure is directed to a hydraulic hammer comprising: a percussion piston arranged for reciprocating movement within a cylinder housing by controlled fluid pressure; a work tool operable by said percussion piston; a piston control valve for controlling the reciprocating movement of said percussion piston in fluid communication with a fluid pressure inlet line adapted to provide pressurised fluid; and a pressure protection valve arranged to provide fluid communication between the fluid pressure inlet line and a low pressure region when the pressure at the fluid pressure inlet line exceeds a predetermined first trigger pressure. The pressure protection valve may be arranged to maintain fluid communication between the fluid pressure inlet line and the low pressure region until the pressure at the fluid pressure inlet line reduces to a pressure below a predetermined second trigger pressure which is less than the first trigger pressure.

In another aspect, the present disclosure is directed to a pressure protection valve for a hydraulic tool having a fluid pressure inlet, the pressure protection valve being adapted to provide a fluid short circuit between the fluid pressure inlet and a low pressure region when the pressure at the fluid pressure inlet exceeds a predetermined first trigger pressure, wherein the pressure protection valve is arranged to provide fluid communication between the fluid pressure inlet and the low pressure region when the pressure at the fluid pressure inlet exceeds a predetermined first trigger pressure. The pressure protection valve may be arranged to maintain fluid communication between the fluid pressure inlet and the low pressure region until the pressure at the fluid pressure inlet reduces to a pressure below a predetermined second trigger pressure which is less than the first trigger pressure.

In another aspect, the present disclosure is directed to a method of disabling a hydraulic tool when fluid pressure in a fluid pressure inlet line which supplies pressurised fluid to the tool reaches or exceeds a predetermined working pressure, comprising:

providing a pressure protection valve arranged between the fluid pressure inlet line and a low pressure region;

using the pressure protection valve to monitor the fluid pressure in the fluid pressure inlet line;

opening the pressure protection valve to provide fluid communication between the fluid pressure inlet line and the low pressure region when the fluid pressure in the fluid pressure inlet line exceeds a predetermined first trigger pressure equal to the predetermined working pressure;

maintaining the pressure protection valve open to provide fluid communication between the fluid pressure inlet line and the low pressure region when the fluid pressure in the fluid pressure inlet line is reduced to a pressure below the predetermined first trigger pressure and above a predetermined second trigger pressure; and closing the pressure protection valve to prevent fluid communication between the fluid pressure inlet line and the low pressure region when the fluid pressure in the fluid pressure inlet line is reduced to a pressure below the predetermined second trigger pressure.

At least one of the above embodiments provides one or more solutions to the problems and disadvantages with the background art. Other technical advantages of the present disclosure will be readily apparent to one skilled in the art from the following description and claims. Various embodiments of the present application obtain only a subset of the advantages set forth. No one advantage is critical to the embodiments. Any claimed embodiment may be technically combined with any other claimed embodiment(s).

BRIEF DESCRIPTION OF THE DRAWINGS

The accompanying drawings illustrate presently preferred exemplary embodiments of the disclosure, and together with the general description given above and the detailed description of the preferred embodiments given below, serve to explain, by way of example, the principles of the disclosure.

DETAILED DESCRIPTION

Figure 1:
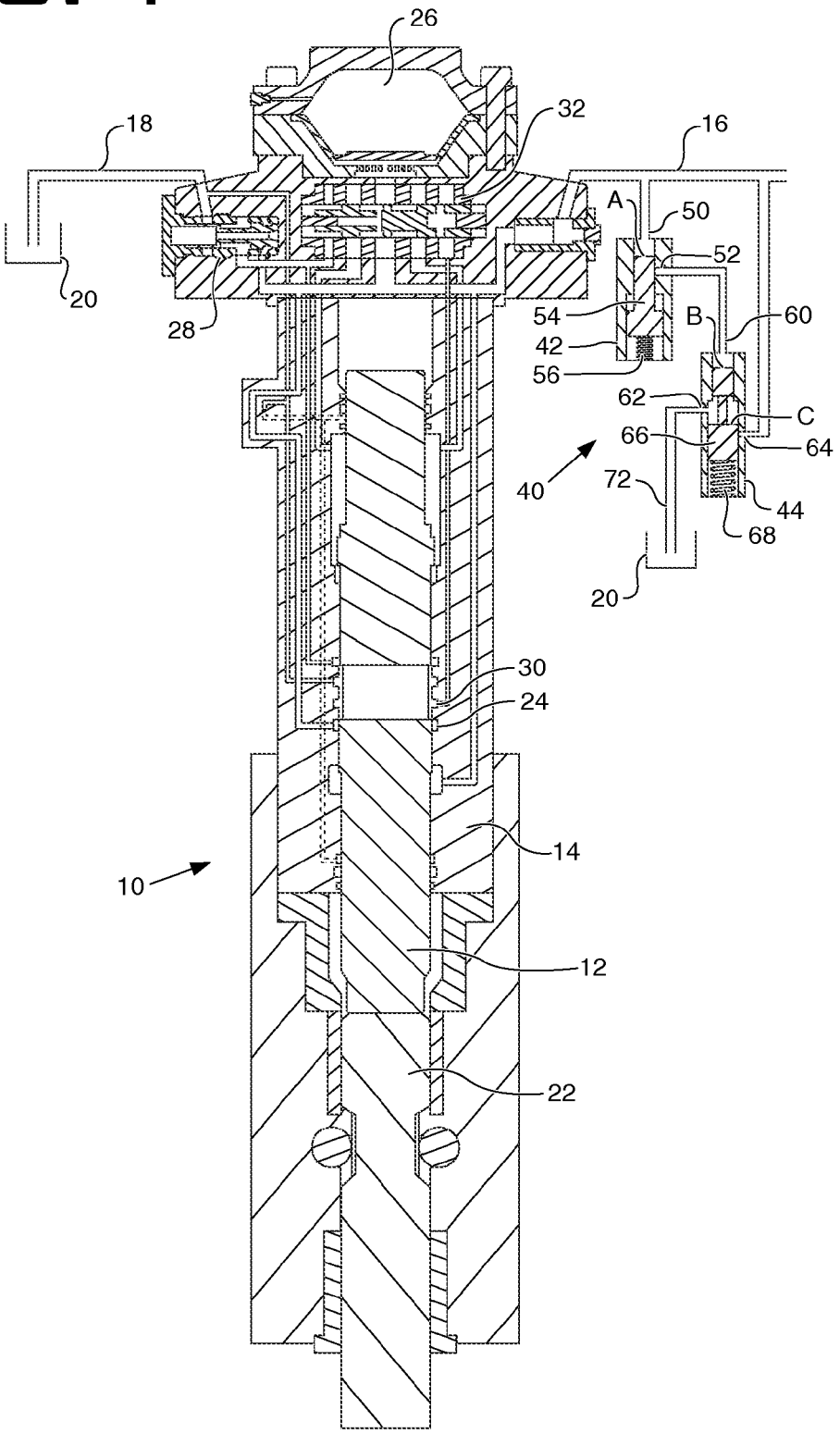
FIG. 1 is a diagrammatic illustration of a hydraulic hammer according to an exemplary embodiment of the present disclosure.

With reference to FIG. 1 there is shown by way of example only a hydraulic tool 10 in the form of a hammer which is connected to a carrier machine (not shown). Although the example shows a hydraulic hammer 10, the pressure protection valve of the present disclosure can be used with any hydraulic or pneumatic tool. The hammer has a percussion piston 12 arranged for reciprocating movement within a cylinder housing 14. A fluid pressure inlet line 16 is connected to a source of pressurised hydraulic fluid on the carrier machine to provide pressurised fluid to the hammer 10. A return line 18 is similarly connected to a low pressure line on the carrier machine, shown schematically as a low pressure region 20. The piston is arranged to contact a work tool 22, such as a chisel, but in the position shown in FIG. 1 there is no contact between the work tool 22 and the material being worked, so hydraulic fluid from the fluid pressure inlet line 16 flows through the hammer 10 via an automatic shutoff operation drain circuit 24 to the return line 18.

When the work tool 22 engages the material being worked, the work tool is pushed into the hammer 10 and the piston 12 is urged upwards, closing the automatic shutoff operation drain circuit 24. The pressure of the hydraulic fluid in the hammer increases and pressurised fluid is stored in an accumulator 26. When the pressure in the accumulator 26 reaches a preset pressure, this causes a pressure control valve 28 to open, so that fluid at the top of the piston 12 is discharged to the return line 18, and the piston 12 moves upward in a return stroke. A pilot port 30 of a piston control valve 32 is exposed to high pressure, which causes the piston control valve 32 to shift and direct high pressure fluid to the top of the piston 12, thereby initiating the operating stroke of the piston 12. At the point of impact between the piston 12 and the work tool 22, the pilot port 30 of the piston control valve 32 is exposed to the low pressure of the return line 18, which causes the piston control valve 32 to shift back in order to divert high pressure fluid once again to the accumulator 26 and initiate the return stroke of the piston 12.

The arrangement by which the piston control valve 32 controls the reciprocating movement of the percussion piston 12 does not form part of the present disclosure, and it will be understood that any appropriate hydraulic circuit or arrangement may be used to control the reciprocating movement of the percussion piston 12.

Figure 2:
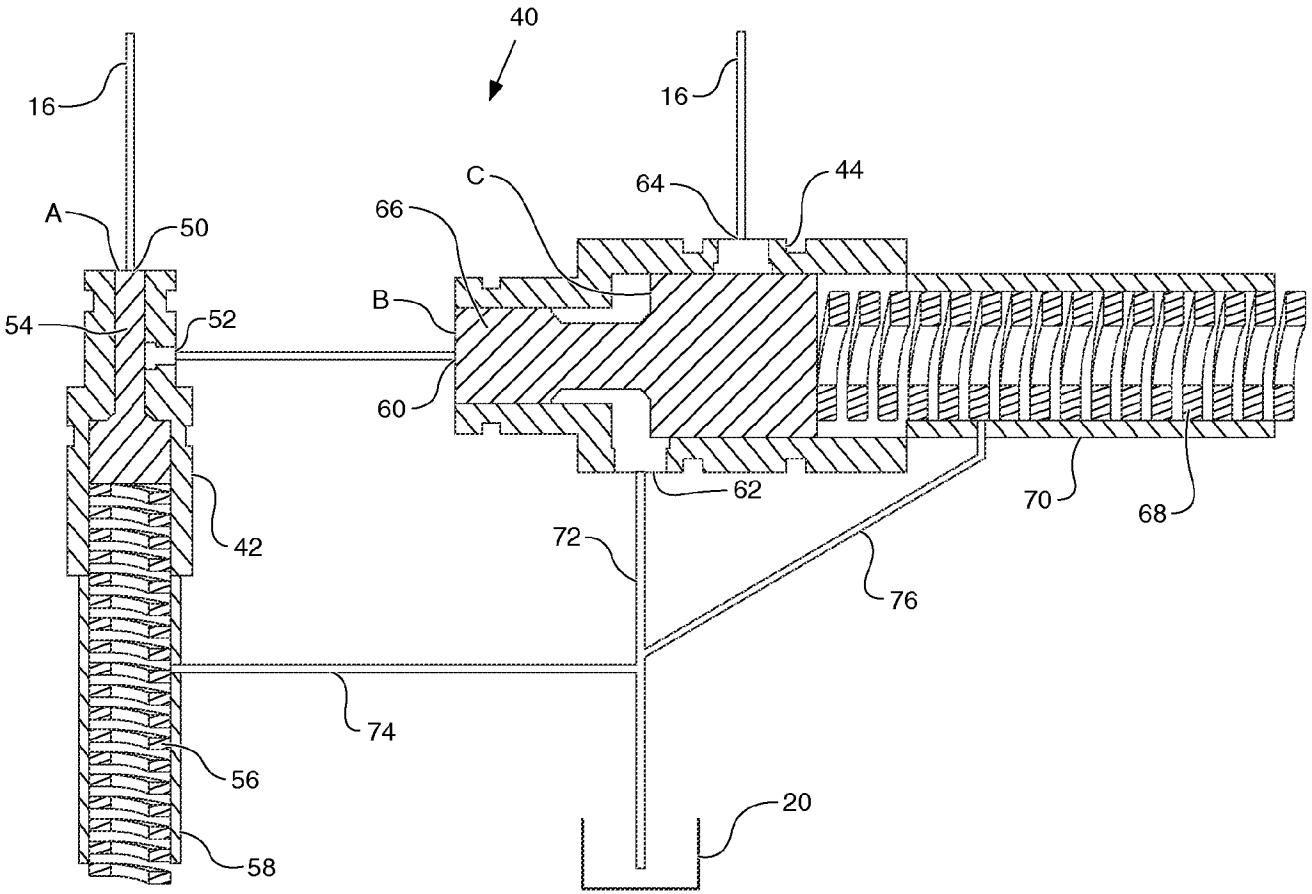
FIG. 2 is a diagrammatic illustration of a pressure protection valve for a hydraulic tool according to another exemplary embodiment of the present disclosure.

A pressure protection valve 40, shown in more detail in FIG. 2, is provided on the hammer 10, either as a separate component attached to the hammer 10, for example by a bolted connection, or as an integrated component built into the hammer body in a similar way to the pressure control valve 28 and piston control valve 32 in the illustrated example. The pressure protection valve 40 is arranged to provide fluid communication between the fluid pressure inlet line 16 and the low pressure region 20 when the pressure at the fluid pressure inlet line 16 exceeds a predetermined first trigger pressure. In the illustrated example the pressure protection valve 40 includes a first spool valve 42 and a second spool valve 44 arranged in series. The first spool valve 42 has a first spool valve input 50 in fluid communication with the fluid pressure inlet line 16, a first spool valve output 52 in fluid communication with the second spool valve 44, and a moveable first spool 54.

The first spool 54 is moveable between a closed position of the first spool valve 42 shown in FIGS. 1 and 2, in which the first spool valve output 52 is closed by the first spool 54 in an upper position, and an open position of the first spool valve 42 in which the first spool valve output 52 is in fluid communication with the first spool valve input 50. When the pressure at the first spool valve input 50 exceeds a predetermined first trigger pressure, equivalent to the maximum permitted operating pressure of the hammer 10, the force resulting from the pressure acting on area A of the first spool 54 is sufficient to overcome the resistance of the biasing component 56, which is typically a spring or similar housed in a sleeve 58, and the first spool 54 moves away from the first spool valve input 50 to an open position in which the first spool valve output 52 is in fluid communication with the first spool valve input 50 and the fluid pressure inlet line 16.

The second spool valve 44 has a second spool valve input 60 in fluid communication with the first spool valve output 52, so that when the first spool valve 42 is in the open position the second spool valve input 60 is subject to the pressure in the fluid pressure inlet line 16.

The second spool valve 44 also has a second spool valve output 62 in communication with the return line 18 or low pressure region 20, a third spool valve input 64 in fluid communication with the fluid pressure inlet line 16, and a moveable second spool 66. The second spool 66 is moveable between a closed position of the second spool valve 44 shown in FIGS. 1 and 2, in which the third spool valve input 64 is closed by the second spool 66, and an open position of the second spool valve 44 in which the third spool valve input 64 is in communication with the second spool valve output 62.

When the first spool valve 42 is in the open position, the force resulting from the pressure acting on area B of the second spool 66 is sufficient to overcome the resistance of the biasing component 68, which is typically a spring or similar housed in a sleeve 70, and the second spool 66 moves away from the second spool valve input 60 to an open position in which the third spool valve input 64 is in fluid communication with the second spool valve output 62 and the return line 18 or low pressure region 20. Although the line 72 from the second spool valve output 62 is shown as being connected to a low pressure region 20, the line 72 may instead be connected directly to the return line 18.

The second spool valve 44 includes a spool surface C which is in fluid communication with the low pressure region 20 when the second spool 66 is in the closed position, but is in fluid communication with both the low pressure region 20 and the fluid pressure inlet line 16 when the second spool 66 is in the open position. The force resulting from the pressure at the third spool valve input acting on spool surface C of the second spool 66 is sufficient to overcome the resistance of the biasing component 68 and hold the second spool 66 in the open position, as long as the pressure remains above a predetermined second trigger pressure. This second trigger pressure may be close to zero.

Additional drain lines 74, 76 may be provided to drain the chambers of the spool valves 42, 44 holding the biasing components 56, 68 to the low pressure region 20.

INDUSTRIAL APPLICABILITY

The pressure protection valve 40 provides protection to a hydraulic tool 10 by disabling the tool when the fluid pressure in the fluid pressure inlet line 16 which supplies pressurised fluid to the tool reaches or exceeds a predetermined working pressure. The pressure protection valve 40 is fitted between the fluid pressure inlet line 16 and the return line 18 or another low pressure region 20, so that when the fluid pressure reaches or exceeds the predetermined working pressure, the pressure protection valve 40 opens to provide fluid communication between the fluid pressure inlet line 16 and the low pressure region 20.

The first spool valve 42 is selected so that it opens when the pressure at the first spool valve input 50 exceeds a predetermined first trigger pressure equal to the predetermined working pressure. In this way the pressure protection valve 40 monitors the fluid pressure in the fluid pressure inlet line 16. The value of the trigger pressure which opens the first spool valve 42 is dependent on the physical properties of the valve, such as the area A, orifice sizes and the biasing force provided by the biasing component 56. The physical properties of the valve are therefore selected in accordance with the maximum permitted operating pressure of the hydraulic tool 10.

When the pressure at the first spool valve input 50 exceeds the predetermined first trigger pressure, the force resulting from the excessive pressure acting on area A of the first spool 54 is sufficient to overcome the resistance of the biasing component 56, and the first spool 54 moves to an open position so that the first spool valve output 52 and the second spool valve input 60 are also at the same excessive pressure. The force resulting from the excessive pressure acting on area B of the second spool 66 is sufficient to overcome the resistance of the biasing component 68, and the second spool 66 moves to an open position, so that the third spool valve input 64 is in fluid communication with the second spool valve output 62. Hence the fluid at excessive pressure in the fluid pressure inlet line 16 is free to flow through the third spool valve input 64, to the second spool valve output 62, and from there to the low pressure region 20. This effectively short circuits the hydraulic tool 10, so that the tool is disabled.

If the pressure in the fluid pressure inlet line 16 falls below the first trigger pressure, the biasing force of the first biasing component 56 will be sufficient to overcome the force due to the pressure acting on area A, and the first spool valve 42 will close. When the first spool valve 42 closes the first spool output 52 may be in communication with the low pressure region 20, so that the second spool input 60 and the area B are no longer subject to the pressure in the fluid pressure inlet line 16. However the spool surface C of the second spool valve 44 remains subject to the pressure in the fluid pressure inlet line 16, which remains sufficient to overcome the resistance of the biasing component 68 as long as it exceeds the predetermined second trigger pressure, and so the second spool valve 44 remains open, so that the tool remains disabled.

The second spool valve 44 closes only when the pressure in the fluid pressure inlet line 16 no longer exceeds the second trigger pressure, at which point the force on the spool surface C is no longer sufficient to overcome the resistance of the biasing component 68, and the biasing component urges the second spool valve closed. The tool 10 can then be operated again, since the fluid circuit is no longer short circuited. The value of the second trigger pressure which closes the second spool valve 44 is dependent on the physical properties of the valve, such as the areas B and C, orifice sizes and the biasing force provided by the biasing component 68. The physical properties of the valve are therefore selected in accordance with the pressure to which it is required that the fluid pressure inlet line 16 should fall before the tool can be operated again. Typically operation of the pressure protection valve will require that flow to the hammer is completely stopped by the operator before the hammer can be restarted, so the second trigger pressure is typically less than 5 bar or close to 0 bar.

Figure 3:
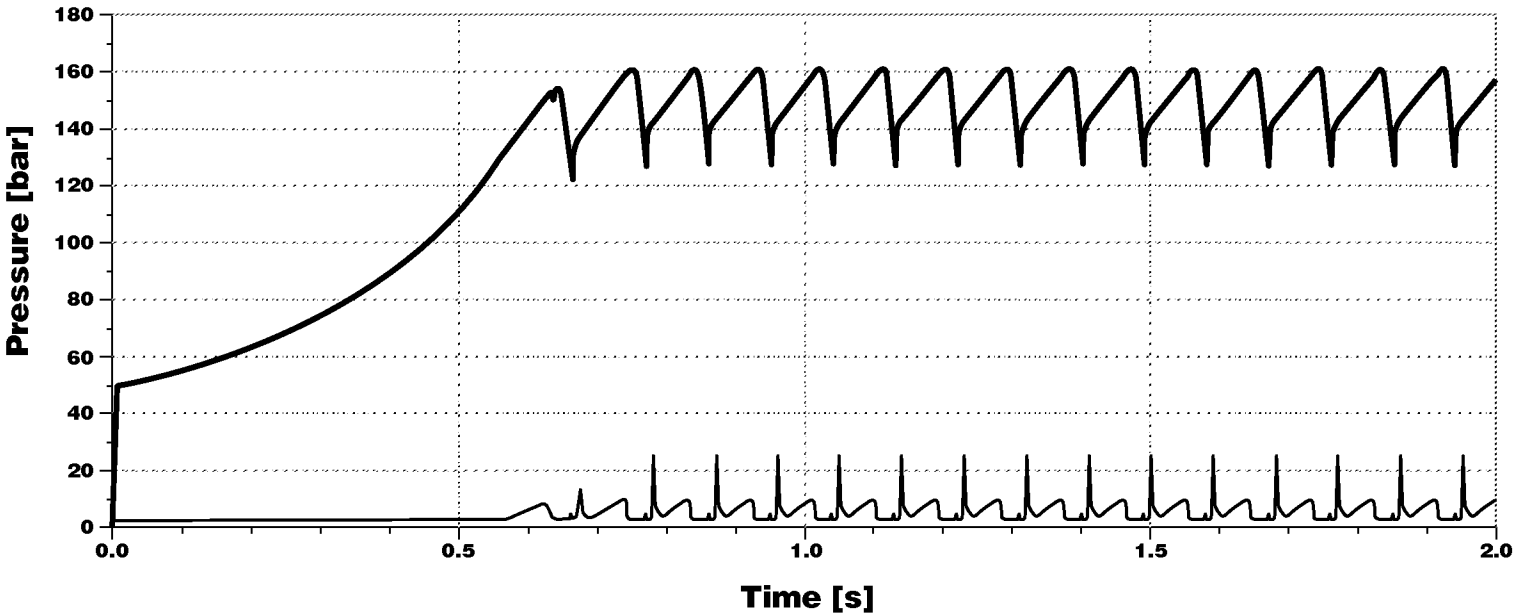
FIG. 3 is a diagrammatic illustration of the variation in pressure in the hydraulic hammer of FIG. 1 with time under normal operation.

FIG. 3 shows the variation in pressure at the fluid pressure inlet line 16 and return line 18 in the hydraulic hammer 10 with time during normal operation of a typical hydraulic hammer 10 incorporating a pressure protection valve 40 according to the present disclosure, with the pressure control valve 28 set to 160 bar and the fluid pressure inlet line 16 supplied with hydraulic fluid from the carrier machine at a design flow rate of 310 liters per minute, and with the return line 18 and low pressure region 20 having a back pressure of 3 bar. Each peak represents a stroke of the piston 12.

Figure 4:
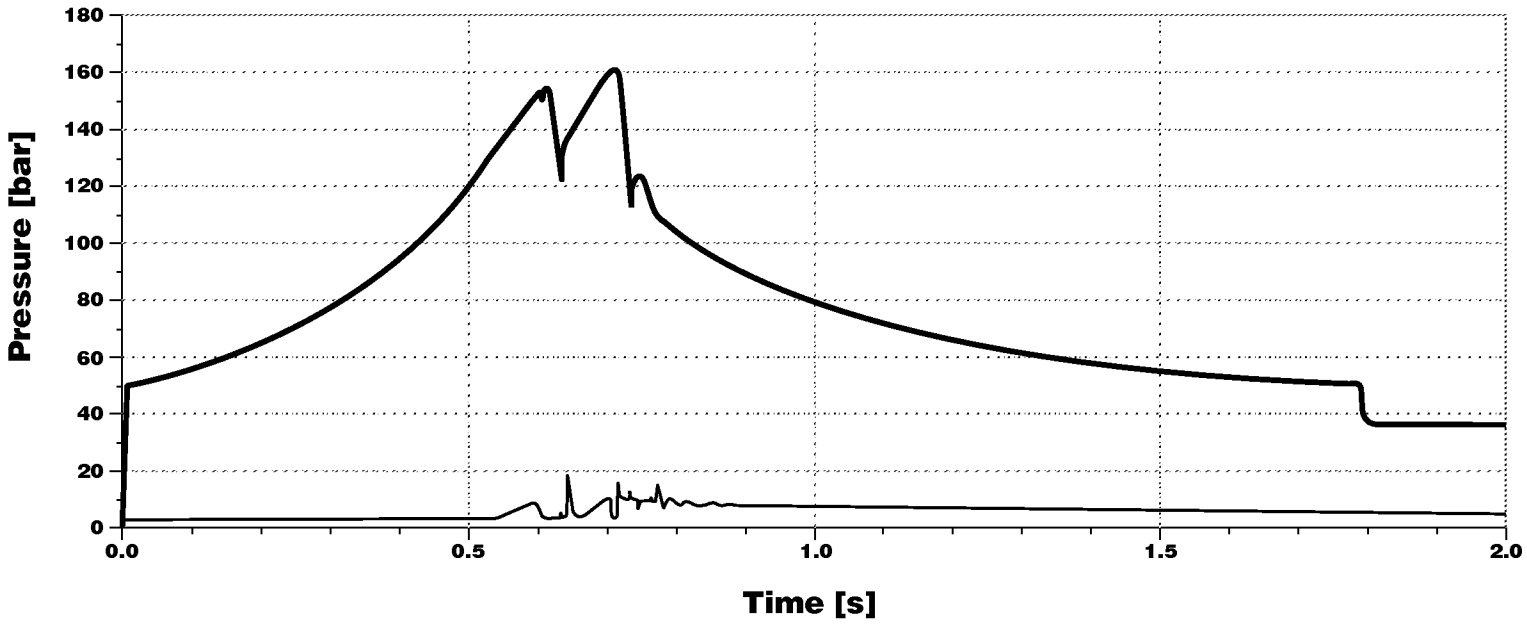
FIG. 4 is a diagrammatic illustration of the variation in pressure in the hydraulic hammer of FIG. 1 with time under operation of the pressure protection valve to disable the hammer.

FIG. 4 shows the variation in pressure at the fluid pressure inlet line 16 and return line 18 in the hydraulic hammer 10 with time during abnormal operation of the same hammer 10, with the pressure control valve 28 still set to 160 bar, but with the fluid pressure inlet line 16 supplied with hydraulic fluid from the carrier machine at an excessive flow rate of 325 liters per minute. The excessive flow rate causes excessive pressure in the fluid pressure inlet line 16, so that the pressure protection valve 40 opens, allowing the hydraulic pressure in the hammer to fall to 50 bar within less than 2 seconds. The predetermined first trigger pressure may be set at a value in excess of 160 bar, for example 170 bar, and the predetermined second trigger pressure may be set at a value below 20 bar, for example 5 bar, so that the tool cannot be operated until the flow to the hammer 10 is stopped by the operator.

The pressure protection valve 40 of the present disclosure prevents damage to a hydraulic tool 10 which can arise through operation at excessive fluid flow or pressure from hydraulic fluid supplied by a carrier vehicle. It can be retrofitted to an existing tool 10. It does not interfere with the operation of the piston control valve 32, since its operation is completely separate from that of the piston control valve 32. It can therefore be used with any hydraulic tool and any form of piston control.

The pressure protection valve 40 of the present disclosure prevents unwanted resumption of the operation of the tool 10 if the input pressure drops below the first trigger pressure, since the hydraulic fluid supply to the tool 10 remains short circuited until the flow of pressurised fluid to the fluid pressure inlet 16 has been stopped by an operator. Only then will the pressure protection valve 40 return to its original closed position, allowing normal operation of the tool 10.

Each of the first and second trigger pressures may be set to suit the requirements of the particular tool 10 and carrier vehicle hydraulic fluid supply.

It will be apparent to those skilled in the art that various modifications and variations can be made to the pressure control valve and method of the present disclosure. The individual spool valves 42, 44 may have a different structure. The pressure control valve 40 may be formed as a separate component or as integrated part of the tool with which it s to be used. Other embodiments will be apparent to those skilled in the art from consideration of the specification and practice of the disclosed pressure control valve and method of disabling a hydraulic tool. It is intended that the specification and examples be considered as exemplary only, with a true scope being indicated by the following claims and their equivalents.

What is claimed is:

1. A hydraulic hammer comprising:

a percussion piston arranged for reciprocating movement within a cylinder housing by controlled fluid pressure;

a work tool operable by said percussion piston;

a piston control valve for controlling the reciprocating movement of said percussion piston in fluid communication with a fluid pressure inlet line adapted to provide pressurised fluid; and a pressure protection valve arranged to:

provide fluid communication between the fluid pressure inlet line and a low pressure region when the pressure at the fluid pressure inlet line exceeds a predetermined first trigger pressure; and maintain fluid communication between the fluid pressure inlet line and the low pressure region until the pressure at the fluid pressure inlet line reduces to a pressure below a predetermined second trigger pressure which is less than the first trigger pressure.

2. A hydraulic hammer according to claim 1, wherein the pressure protection valve includes a first spool valve and a second spool valve arranged in series, the first spool valve having a first spool valve input in fluid communication with the fluid pressure inlet line and a first spool valve output in fluid communication with the second spool valve, and the first spool valve being moveable between a closed position in which the first spool valve output is closed when the pressure at the first spool valve input does not exceed the predetermined first trigger pressure and an open position in which the first spool valve output is in fluid communication with the fluid pressure inlet line when the pressure at the first spool valve input exceeds the predetermined first trigger pressure.

3. A hydraulic hammer according to claim 2, wherein the second spool valve has a second spool valve input in fluid communication with the first spool valve output, a second spool valve output in fluid communication with a low pressure region and a third spool valve input in fluid communication with the fluid pressure inlet line, the second spool valve being moveable between a closed position in which the second spool valve output is not in communication with the third spool valve input when the pressure at the second spool valve input does not exceed the predetermined first trigger pressure and an open position in which the second spool valve output is in fluid communication with the third spool valve input when the pressure at the second spool valve input exceeds the predetermined first trigger pressure.

4. A hydraulic hammer according to claim 3, wherein the second spool valve includes a spool surface which is in fluid communication with the third spool valve input when the second spool valve is in the open position, the spool surface being adapted to hold the second spool valve in the open position while the pressure at the third spool valve input exceeds the predetermined second trigger pressure.

5. A hydraulic hammer according to claim 3, wherein the first spool valve includes a first biasing component adapted to urge the first spool valve towards the closed position, and wherein the second spool valve includes a second biasing component adapted to urge the second spool valve towards the closed position.

6. A pressure protection valve for a hydraulic tool having a fluid pressure inlet, the pressure protection valve being adapted to provide a fluid short circuit between the fluid pressure inlet and a low pressure region when the pressure at the fluid pressure inlet exceeds a predetermined first trigger pressure, wherein the pressure protection valve is arranged to:

provide fluid communication between the fluid pressure inlet and a low pressure region when the pressure at the fluid pressure inlet exceeds a predetermined first trigger pressure; and maintain fluid communication between the fluid pressure inlet and the low pressure region until the pressure at the fluid pressure inlet reduces to a pressure below a predetermined second trigger pressure which is less than the first trigger pressure.

7. A pressure protection valve according to claim 6, including a first spool valve and a second spool valve arranged in series, the first spool valve having a first spool valve input adapted to be in fluid communication with the fluid pressure inlet line and a first spool valve output in fluid communication with the second spool valve, and the first spool valve being moveable between a closed position in which the first spool valve output is closed when the pressure at the first spool valve input does not exceed the predetermined first trigger pressure and an open position in which the first spool valve output is in fluid communication with the first spool valve input when the pressure at the first spool valve input exceeds the predetermined first trigger pressure.

8. A pressure protection valve according to claim 7, wherein the second spool valve has a second spool valve input in fluid communication with the first spool valve output, a second spool valve output adapted to be in fluid communication with a low pressure region and a third spool valve input adapted to be in fluid communication with the fluid pressure inlet line, the second spool valve being moveable between a closed position in which the second spool valve output is not in communication with the third spool valve input when the pressure at the second spool valve input does not exceed the predetermined first trigger pressure and an open position in which the second spool valve output is in fluid communication with the third spool valve input when the pressure at the second spool valve input exceeds the predetermined first trigger pressure.

9. A pressure protection valve according to claim 8, wherein the second spool valve includes a spool surface which is in fluid communication with the third spool valve input when the second spool valve is in the open position, the spool surface being adapted to hold the second spool valve in the open position while the pressure at the third spool valve input exceeds the predetermined second trigger pressure.

10. A pressure protection valve according to claim 8, wherein the spool valve includes a first biasing component adapted to urge the first spool valve towards the closed position, and wherein the second spool valve includes a second biasing component adapted to urge the second spool valve towards the closed position.

11. A method of disabling a hydraulic tool when fluid pressure in a fluid pressure inlet line which supplies pressurised fluid to the tool reaches or exceeds a predetermined working pressure, comprising:

providing a pressure protection valve arranged between the fluid pressure inlet line and a low pressure region;

using the pressure protection valve to monitor the fluid pressure in the fluid pressure inlet line;

opening the pressure protection valve to provide fluid communication between the fluid pressure inlet line and the low pressure region when the fluid pressure in the fluid pressure inlet line exceeds a predetermined first trigger pressure equal to the predetermined working pressure;

maintaining the pressure protection valve open to provide fluid communication between the fluid pressure inlet line and the low pressure region when the fluid pressure in the fluid pressure inlet line is reduced to a pressure below the predetermined first trigger pressure and above a predetermined second trigger pressure; and closing the pressure protection valve to prevent fluid communication between the fluid pressure inlet line and the low pressure region when the fluid pressure in the fluid pressure inlet line is reduced to a pressure below the predetermined second trigger pressure.

12. A method according to claim 11, wherein the pressure protection valve includes a first spool valve and a second spool valve arranged in series, and wherein the step of providing the pressure protection valve includes:

arranging a first spool valve input of the first spool valve in fluid communication with the fluid pressure inlet line;

arranging a first spool valve output of the first spool valve in fluid communication with a second spool valve input of the second spool valve;

arranging a third spool valve input of the second spool valve in fluid communication with the fluid pressure inlet line; and arranging a second spool valve output of the second spool valve in fluid communication with the low pressure region.

13. A method according to claim 12, wherein the step of opening the pressure protection valve includes:

moving the first spool valve from a closed position in which the first spool valve output is closed to an open position in which the first spool valve output is in fluid communication with the fluid pressure inlet line; and moving the second spool valve from a closed position in which the second spool valve output is not in fluid communication with the third spool valve input to an open position in which the second spool valve output is in fluid communication with the third spool valve input.

14. A method according to claim 13, wherein the step of maintaining the pressure protection valve open includes:

using a first biasing component to urge the first spool valve towards the closed position against the reduced fluid pressure at the first spool valve input; and applying fluid pressure from the third spool valve input to a spool surface of the second spool valve to hold the second spool valve in the open position.

15. A method according to claim 14, wherein the step of closing the pressure protection valve includes:

using a second biasing component to urge the second spool valve towards the closed position against the reduced fluid pressure from the third spool valve input acting on the spool surface.

* * * * *